US009239033B2

(12) United States Patent
Hasegawa et al.

(10) Patent No.: US 9,239,033 B2
(45) Date of Patent: Jan. 19, 2016

(54) FUEL VAPOR TREATMENT SYSTEM

(71) Applicant: DENSO CORPORATION, Kariya, Aichi-pref. (JP)

(72) Inventors: Shigeru Hasegawa, Nagoya (JP); Tomohiro Itoh, Tokai (JP); Kosei Takagi, Novi, MI (US); Makoto Kaneko, Nishio (JP)

(73) Assignee: DENSO CORPORATION, Kariya (JP)

( * ) Notice: Subject to any disclaimer, the term of this patent is extended or adjusted under 35 U.S.C. 154(b) by 217 days.

(21) Appl. No.: 13/970,901

(22) Filed: Aug. 20, 2013

(65) Prior Publication Data

US 2014/0060498 A1 Mar. 6, 2014

(30) Foreign Application Priority Data

Aug. 30, 2012 (JP) ..... 2012-190408

(51) Int. Cl.
*F02M 25/08* (2006.01)

(52) U.S. Cl.
CPC ..... *F02M 25/08* (2013.01); *F02M 25/0818* (2013.01)

(58) Field of Classification Search
CPC ..... F02M 25/08; F02M 25/0854; F02M 25/0872; F02M 25/089; F02M 37/22; F02M 37/103; F02M 39/00
USPC ..... 123/495, 497, 509, 516–521; 73/114.39, 114.41–114.43
See application file for complete search history.

(56) References Cited

U.S. PATENT DOCUMENTS

| | | | | |
|---|---|---|---|---|
| 5,347,971 | A * | 9/1994 | Kobayashi et al. | 123/520 |
| 7,347,191 | B2 * | 3/2008 | Atwood et al. | 123/516 |
| 2003/0226549 | A1 * | 12/2003 | Takagi et al. | 123/520 |
| 2007/0157908 | A1 | 7/2007 | Kano et al. | |
| 2011/0186020 | A1 * | 8/2011 | Makino | 123/521 |
| 2011/0253110 | A1 * | 10/2011 | Fukui | 123/520 |
| 2011/0311385 | A1 | 12/2011 | Kobayashi et al. | |
| 2012/0047999 | A1 | 3/2012 | Itoh et al. | |
| 2012/0130596 | A1 * | 5/2012 | Ooiwa | 701/45 |

FOREIGN PATENT DOCUMENTS

| | | |
|---|---|---|
| JP | 2004-300997 | 10/2004 |
| JP | 2007-127065 | 5/2007 |
| JP | 2008-095564 | 4/2008 |

OTHER PUBLICATIONS

JP 2007-127065A English Translation Version.*
Office Action (2 pages) dated Jul. 29, 2014 issued in corresponding Japanese Application No. 2012-190408 and English translation (2 pages).

* cited by examiner

*Primary Examiner* — John Kwon
*Assistant Examiner* — Johnny H Hoang
(74) *Attorney, Agent, or Firm* — Nixon & Vanderhye PC

(57) ABSTRACT

An ECU controls a selector valve so as to connect a first pump passage and a second pump passage, and determines whether a fuel vapor leak from a fuel tank is in an allowable range based on a pressure in the fuel tank which is detected by a pressure sensor while a pump is driven to decrease a pressure in the fuel tank. The ECU opens a purge valve, whereby the fuel vapor adsorbed by a canister is introduce into an engine through an intake passage. The ECU controls the selector valve to connect a first pump passage and the second pump passage so as to circulate an atmospheric air in the pump while the purge valve is opened to introduce the fuel vapor into the internal combustion engine, whereby a foreign matter in the pump can be removed.

11 Claims, 8 Drawing Sheets

FUEL VAPOR TREATMENT SYSTEM

CROSS-REFERENCE TO RELATED APPLICATION

This application is based on Japanese Patent Application No. 2012-190408 filed on Aug. 30, 2012, the disclosure of which is incorporated herein by reference.

TECHNICAL FIELD

The present invention relates to a fuel vapor treatment system treating a fuel vapor generated in a fuel tank.

BACKGROUND

It is known that a fuel vapor treatment system determines whether a fuel vapor leak from a fuel tank is in an allowable range based on a pressure in the fuel tank which is detected while a pump is driven to decrease or increase the pressure in the fuel tank. For example, in the fuel vapor treatment system shown in JP-2012-2207A, an interior of a fuel tank is depressurized or pressurized by a vane type pump.

The vane type pump has a housing, a rotor rotatably accommodated in the housing, a vane provided to the rotor in such a manner as to radially reciprocate, and a motor driving the rotor. A tip end of the vane is slidably in contact with an inner wall surface of the housing. When foreign matters are introduced into the interior of the pump, or when worn powders of the vane and the housing accumulate in the pump, a clearance between a rotating part (a rotor, a vane) and a stationary parts (housing) is decreased, which may deteriorates a pump performance. If large amount of foreign matters are introduced or if large amount of the worn powders accumulate, it is likely that the rotation of the rotor may be locked. Furthermore, there is a possibility that a secondary wear may be accelerated and an abrasive wear may occur.

SUMMARY

It is an object of the present disclosure to provide a fuel vapor treatment system which can restrict a deterioration of a pump performance.

According to the present disclosure, a fuel vapor treatment system is provided with a purge passage, a canister, a purge valve, a first pump passage, a second pump passage, a pump, a first atmospheric passage, a second atmospheric passage, a selector valve, a pressure detector, and a control unit. The purge passage is connected to a fuel tank and an intake passage which introduces an intake air to an internal combustion engine. The canister is provided in the purge passage for adsorbing a part of the fuel vapor flowing through the purge passage. The purge valve is provided in the purge passage between the canister and the intake passage for opening and closing the purge passage. One end of the first pump passage is connected to the canister. The second pump passage is defined in such a manner that its one end is capable of being connected to another end of the first pump passage. The pump is an electric pump which is connected to another end of the second pump passage. The pump can depressurize or pressurize the interior of the fuel tank through the second pump passage, the first pump passage, the canister, and the first purge passage. One end of the first atmospheric passage 51 is connected to the pump, and another end is opened to the atmosphere. One end of the second atmospheric passage is connected to the first atmospheric passage. The selector valve is provided between another end of the first pump passage, one end of the second pump passage, and another end of the second atmospheric passage. The selector valve switches a passage connection between a first position in which the first pump passage is connected to the second pump passage and a second position in which the first pump passage is connected to the second atmospheric passage. The pressure detector detects the pressure in the second pump passage. The control unit controls the operations of the purge valve, the pump and the selector valve.

The control unit has a fuel-vapor-leak determining portion, a fuel purge portion, and a foreign matter removing portion. The fuel-vapor-leak determining portion determines whether a fuel vapor leak from the fuel tank is in an allowable range based on the pressure detected by the pressure detector in a condition where the selector valve connects the first pump passage and the second pump passage while the pump is driven in order to pressurize or depressurize the interior of the fuel tank. The fuel purge portion opens a purge valve, whereby the fuel vapor adsorbed by a canister is introduce into an engine through an intake passage. The foreign matter removing portion controls the selector valve to connect a first pump passage and the second pump passage so as to circulate an atmospheric air in the pump while the purge valve is opened to introduce the fuel vapor into the internal combustion engine, whereby a foreign matter in the pump can be removed.

As explained above, according to the present disclosure, the foreign matter removing portion can remove the foreign matters in the pump. Thereby, it can be restricted that the pump performance is deteriorated. Therefore, a stable pump performance can be surely maintained for a long time period. As a result, it can be determined whether a fuel vapor leak exists with high accuracy.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
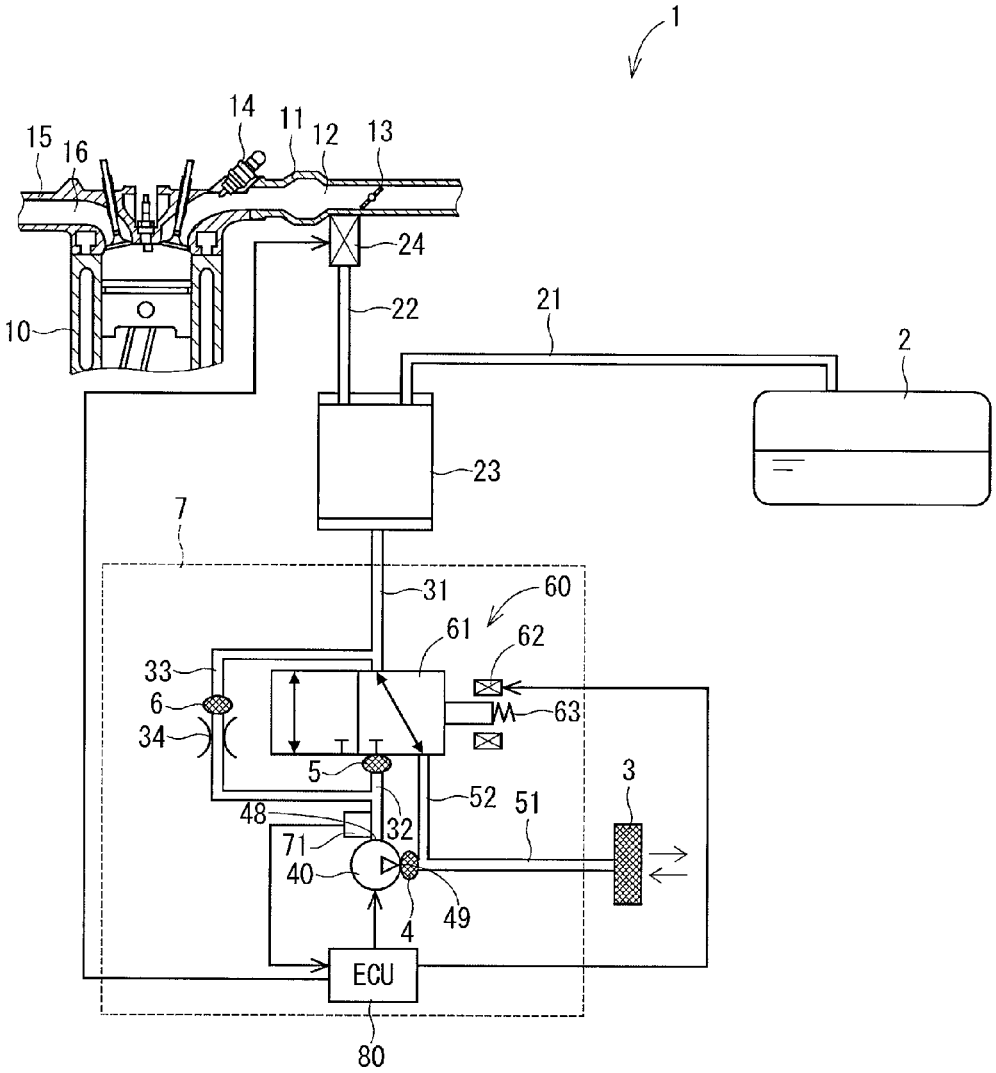
FIG. 1 is a schematic view showing a configuration of a fuel vapor treatment system according to a first embodiment.

A plurality of embodiment of the present disclosure will be described hereinafter. In each embodiment, the substantially same parts and the components are indicated with the same reference numeral and the same description will not be reiterated.

First Embodiment

FIG. 1 is a schematic view showing a fuel vapor treatment system 1 according to a first embodiment.

The fuel vapor treatment system 1 is applied to a suction system of an internal combustion engine 10. The engine 10 is provided with an intake pipe 11 which defines an intake passage 12 therein. One end of the intake pipe 11 is opened to atmosphere. Thereby, fresh intake air is introduced into the engine 10 through the intake passage 12.

A throttle valve 13 is disposed in the intake passage 12. The throttle valve 13 adjusts an intake air flow rate which is introduced into the engine 10. A fuel injector 14 is provided to the intake pipe 11 between the throttle valve 13 and the engine 10. The fuel injector 14 injects gasoline as fuel stored in a fuel tank 2 toward the intake passage 12. The injected fuel is introduced into the engine 10 with the intake air. The fuel introduced into the engine 10 is combusted in a combustion chamber. The combusted fuel (exhaust gas) is discharged to atmosphere through an exhaust passage 16 defined by an exhaust pipe 15. In the fuel tank 2, the stored gasoline evaporates. This evaporated gasoline is referred to as fuel vapor.

The fuel vapor treatment systems 1 is provided with a first purge passage 21, a second purge passage 22, a canister 23, a purge valve 24, a first pump passage 31, a second pump passage 32, a pump 40, a first atmospheric passage 51, a second atmospheric passage 52, a selector valve 60, a pressure sensor 71, and an electronic control unit (ECU) 80. The fuel vapor treatment system 1 is mounted to a vehicle in order to introduce the fuel vapor generated in the fuel tank 2 into the engine 10.

One end of the first purge passage 21 is connected to the fuel tank 2. Meanwhile, one end of the second purge passage 22 is connected to the intake passage 12. The canister 23 is arranged in such a manner as to connect another end of the first purge passage 21 and another end of the second purge passage 22. Thereby, the first purge passage 21 and the second purge passage 22 connect the fuel tank 2 and the intake passage 12 through the canister 23.

The canister 23 has adsorbents, such as activated carbon, therein. The adsorbents adsorb a part of fuel vapor flowing through the first purge passage 21 and the second purge passage 22. A part of the fuel vapor adsorbed by the canister 23 is purged from the canister 23 and flows into the intake passage 12 through the second purge passage 22. The canister 23 restricts an emission of the fuel vapor to the atmosphere and an adhesion of the fuel vapor on a pump 40 and the like.

The purge valve 24 is an electromagnetic-drive control valve and is arranged in the second purge passage 22. The purge valve 24 opens or closes the second purge passage 22 to permit or intercept a fuel vapor flow from the second purge passage 22 toward the intake passage 12. The purge valve 24 is a normally closed valve. When deenergized, the purge valve 24 is closed. When energized, the purge valve 24 is opened.

One end of the first pump passage 31 is connected to the canister 23. The second pump passage 32 is defined in such a manner that its one end is capable of being connected to another end of the first pump passage 31. The pump 40 is arranged in such a manner that its first fluid port 48 is connected to the second pump passage 32. The pump 40 is an electric rotary pump which suctions the fluid through the first fluid port 48 and discharges the fluid through the second fluid port 49. Alternatively, the pump suctions the fluid through the second fluid port 49 and discharges the fluid through the first fluid port 48. Thereby, the pump 40 can depressurize or pressurize the interior of the fuel tank 2 through the second pump passage 32, the first pump passage 31, the canister 23, and the first purge passage 21.

Figure 2A:
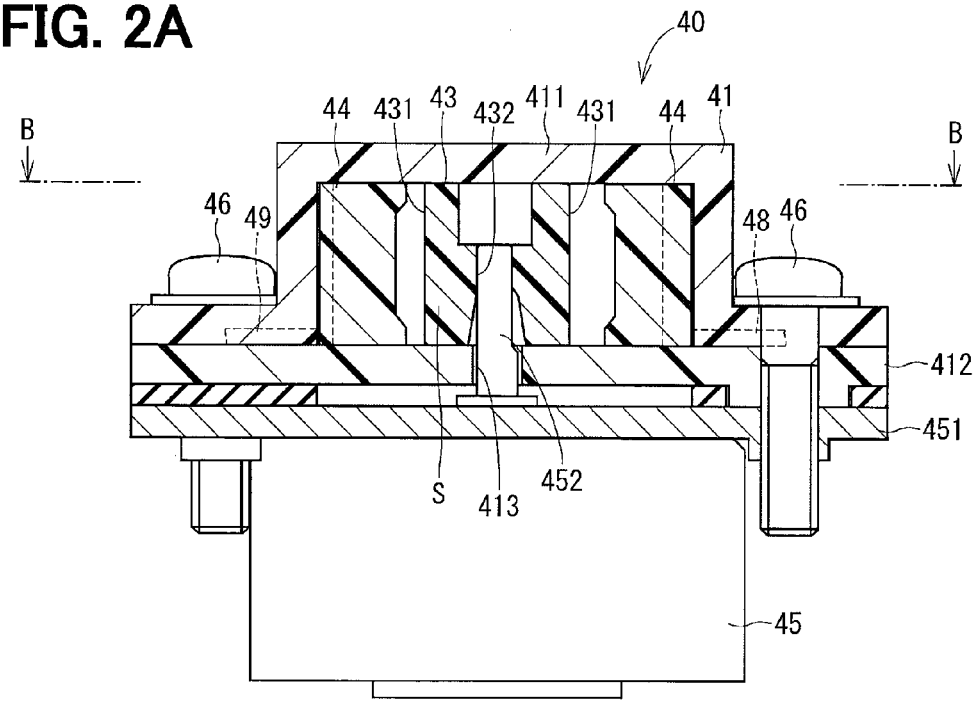
FIG. 2A is a sectional view showing a pump of a fuel vapor treatment system according to the first embodiment.
Figure 2B:
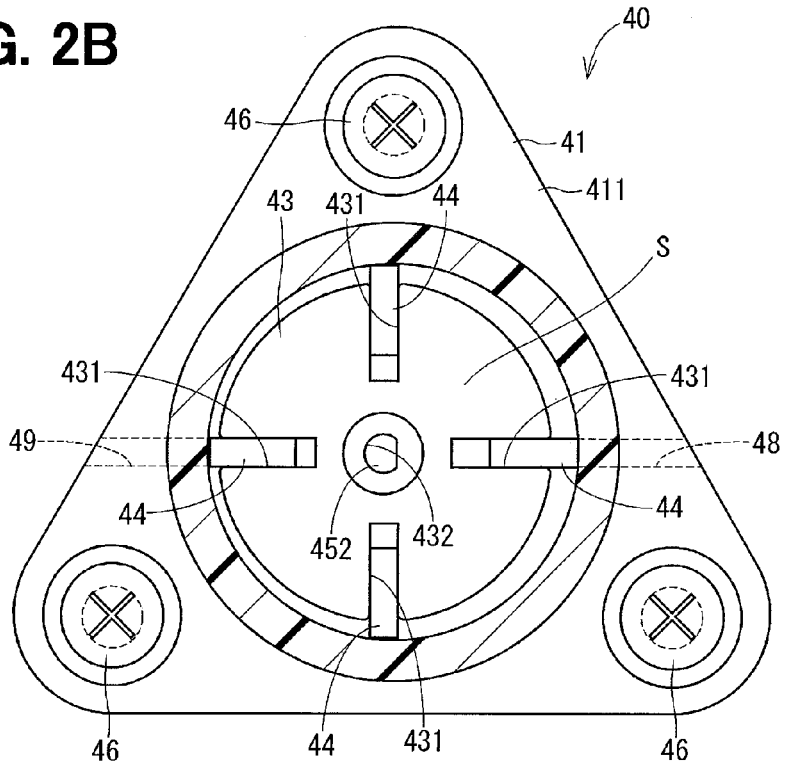
FIG. 2B is a sectional view taken along a line IIB-IIB in FIG. 2A.

A configuration of the pump 40 will be described hereinafter. As shown in FIGS. 2A and 2B, the pump 40 has a housing 41, a rotor 43, a vane 44 and a motor 45. The housing 41 is comprised of an upper housing 411 and a lower housing 412. The upper housing 411 is made of resin material, and forms a cylindrical concave portion. The lower housing 412 is also made of resin material, and is formed in plate-shape. The upper housing 411 and the lower housing 412 are brought into contact with each other, so that a cylindrical interior space "S" is defined therebetween. The first and the second fluid port 48, 49 are formed in the upper housing 411. Both fluid ports 48, 49 connect the interior space "S" and the exterior. The upper housing 411 and the lower housing 412 are connected to a flange portion 451 of the motor 45 through a bolt 46.

The rotor 43 is cylindrically formed from resin material, and is accommodated in the interior space "S". The rotor 43 has a groove 431 which radially extends from one end surface to another end surface. In the present embodiment, the rotor 43 has four grooves 431 in its circumferential direction at regular intervals. The vane 44 is made of resin material and is formed in a rectangular plate shape. The vane 44 is accommodated in each of grooves 431. The vane 44 can radially reciprocate in each groove 431.

The motor 45 is an electric motor. The motor 45 has a shaft 452 which is inserted into a hole 413 formed in the lower housing 412. A tip end of the shaft 452 is inserted into a hole 432 formed at a center of the rotor 43. Thereby, when the motor 45 is energized, the shaft 452 and the rotor 43 rotate together. As a result, the vane 44 rotates along with the rotor 43 and reciprocates in the groove 431 while its outer end is slidably in contact with an inner wall surface of the housing 41.

When the motor 45 is energized and the rotor 43 and the vane 44 are rotated, the pump 40 suctions the fluid through the first fluid port 48 and discharges the fluid through the second fluid port 49. Alternatively, the pump 40 suctions the fluid through the second fluid port 49 and discharges the fluid through the first fluid port 48. That is, the pump 40 is a vane type pump. One end of the first atmospheric passage 51 is connected to the second fluid port 49, and the other end is opened to the atmosphere. One end of the second atmospheric passage 52 is connected to the first atmospheric passage 51.

In present embodiment, a filter 3 is provided to the other end of the first atmospheric passage 51. The filter 3 is made of non-woven fabric to remove foreign matters in the air flowing into the first atmospheric passage 51.

The selector valve 60 is arranged between the other end of the first pump passage 31, one end of the second pump passage 32, and the other end of the second atmospheric passage 52. The selector valve 60 has a valve body 61, an electromagnetic driving portion 62 and a biasing portion 63. The valve body 61 reciprocates between the first pump passage 31, the second pump passage 32, and the second atmospheric passage 52. According to the position of the valve body 61, the first pump passage 31 is connected to the second pump passage 32, or the first pump passage 31 is connected to the second atmospheric passage 52. When energized, the electromagnetic driving portion 62 generates a magnetic force to attract the valve body 61. The biasing portion 63 biases the valve body 61 in a direction opposite to the above magnetic attracting force.

When the electromagnetic driving portion 62 is deenergized, the selector valve 60 is positioned at an OFF-position so the first pump passage 31 and the second atmospheric passage 52 are communicated with each other and the first pump passage 31 and the second pump passage 32 are disconnected with each other. Meanwhile, when the electromagnetic driving portion 62 is energized, the selector valve 60 is positioned at an ON-position so the first pump passage 31 and the second pump passage 32 are communicated with each other and the first pump passage 31 and the second atmospheric passage 52 are disconnected with each other.

A pressure sensor 71 is arranged in the second pump passage 32 to detect the pressure in the second pump passage 32. The pressure sensor 71 corresponds to a pressure detector.

The ECU 80 is a computer having a CPU, a ROM, a RAM, an input/output. The ECU 80 executes programs stored in the ROM based on various signals from sensors mounted to the vehicle. The ECU 80 controls the purge valve 24, the pump 40, and selector valve 60. The ECU 80 corresponds to a "control unit". The pressure sensor 71 transmits signals indicative of the detected pressure to the ECU 80. Thereby, the ECU 80 can detect the pressure in the second pump passage 32.

In the present embodiment, the ECU 80 controls the electric power supplied to the motor 45 so that the motor 45 rotates at a constant speed. The ECU 80 controls the electric power supplied to the motor 45 so that the rotation speed of the motor 45 becomes constant. For example, in a case that a load of the motor 45 is increased and the rotation speed of the motor 45 is decreased, the ECU 80 increases the electric power supplied to the motor 45 so that the rotation speed of the motor 45 becomes constant.

The fuel vapor treatment system 1 is further provided with an orifice passage 33 and an orifice 34. The orifice passage 33 is provided to connect the first pump passage 31 and the second pump passage 32. The orifice 34 is arranged in the orifice passage 33. An inner diameter of the orifice 34 is established in such a manner as to correspond to an aperture through which the fuel vapor in the fuel tank 2 is permissibly leaked. For example, according to the regulations of CARB and EPA, the inner diameter of the aperture is 0.5 mm or less. Thus, the orifice 34 has an inner diameter which is 0.5 mm or less.

Moreover, the fuel vapor treatment system 1 is provided with filters 4, 5, and 6 which are made of non-woven fabrics. The filter 4 is arranged in the first atmospheric passage 51 at a position close to the pump 40 in order to remove foreign matters contained in the fluid flowing through the first atmospheric passage 51. The filter 5 is arranged in the second pump passage 32 at a position close to the selector valve 60 in order to remove foreign matters contained in the fluid flowing through the second pump passage 32. The filter 6 is arranged in the orifice passage 33 at a position close to the orifice 34 in order to remove foreign matters contained in the fluid flowing through the orifice passage 32. Relative to the orifice 34, the filter 6 is arranged at a side of the first pump passage 31.

Hereafter, an operation of the fuel vapor treatment system 1 will be explained.

(Normal)

When the vehicle and the engine 10 are normally stopped, the purge valve 24, the pump 40, and the selector valve 60 are at OFF-position, as shown in FIG. 1. The purge valve 24 is closed, the pump 40 is not driven, and the carried out, and the pump 40 does not operate. The selector valve 60 is positioned at the OFF-position so the first pump passage 31 and the second atmospheric passage 52 are communicated with each other and the first pump passage 31 and the second pump passage 32 are disconnected with each other. At this time, the fuel vapor generated in the fuel tank 2 flows through the first purge passage 21 and is adsorbed by the canister 23. Therefore, it is restricted that the fuel vapor generated in the fuel tank 2 is emitted to the atmosphere through the first pump passage 31, the second atmospheric passage 52 and the first atmospheric passage 51. At this time, since the interior of the fuel tank 2 is connected to the atmosphere through the first purge passage 21, the canister 23, the first pump passage 31, the second atmospheric passage 52, and the first atmospheric passage 51, the fuel in the fuel tank 2 is favorably supplied to the engine 10.

(Reference Pressure Detection)

Figure 3:
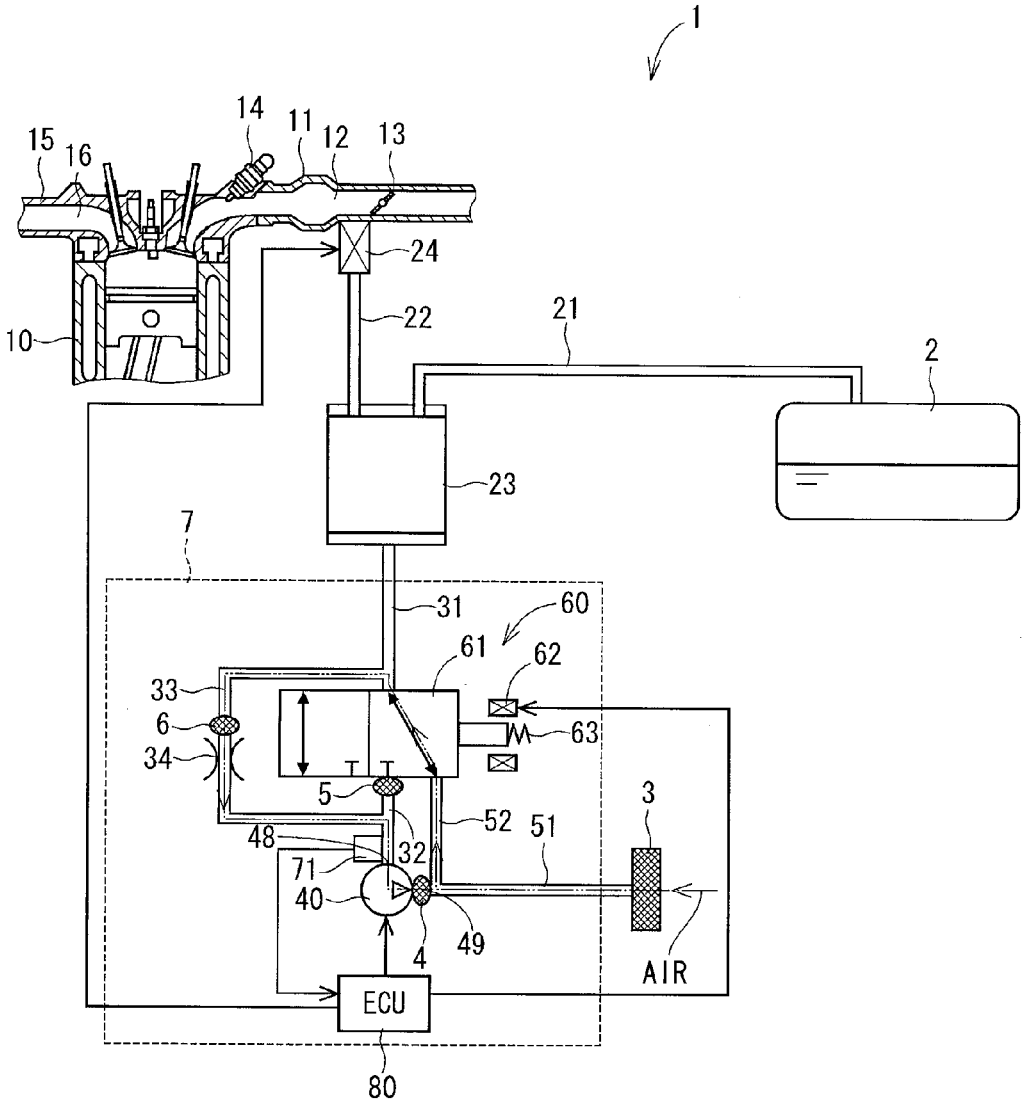
FIG. 3 is a schematic view showing a configuration of a fuel vapor treatment system at a reference pressure detection, according to the first embodiment.

When the vehicle is stopped and the engine 10 is shut down, the temperature in the fuel tank 2 and the temperature of the engine 10 are decreased. When these temperatures become stable at specified values, the ECU 80 drives the pump 40 (ON-control). As shown in FIG. 3, the ECU 80 closes the purge valve 24 (OFF-control), drives the selector valve 60 to the OFF-position to connect the first pump passage 31 and the second atmospheric passage 52 (OFF-control), and drives the pump 40 in such a manner that the pump 40 suctions the fluid through the first fluid port 48 and discharges the fluid through the second fluid port 49 (ON-control). Thereby, the interior of the second pump passage 32 is depressurized.

When the pressure in the second pump passage 32 becomes lower than the atmospheric pressure, the atmospheric air flows into the first atmospheric passage 51 through the filter 3. Then, the atmospheric air flows through the second atmospheric passage 52, the selector valve 60, the first pump passage 31, the orifice passage 33, the orifice 34, and the second pump passage 32 to the pump 40. Thereby, the air flow flowing through the second atmospheric passage 52, the first pump passage 31, the orifice passage 33, the orifice 34, the second pump passage 32, the pump 40, and the first atmospheric passage 51 is formed.

At this time, the pressure in the second pump passage 32 is substantially equal to the internal pressure of the fuel tank 2 when the pump 40 depressurizes the fuel tank 2 having an aperture through which the fuel vapor in the fuel tank 2 is permissibly leaked. The ECU 80 stores the pressure in the second pump passage 32 detected by the pressure sensor 71 as the reference pressure "Ps".

(Fuel Vapor Leak Determination)

Figure 4:
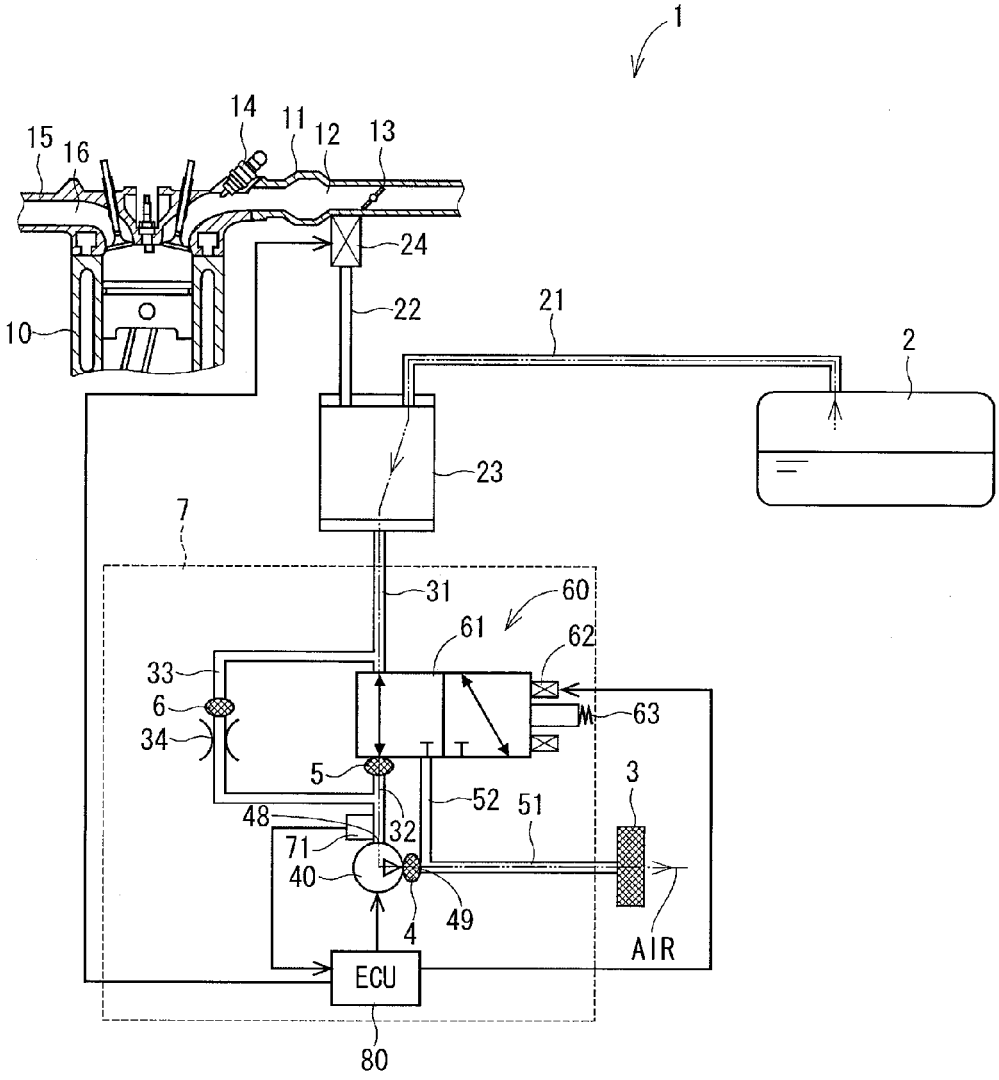
FIG. 4 is a schematic view showing a configuration of a fuel vapor treatment system at a fuel vapor leak determination, according to the first embodiment.

As shown in FIG. 4, after the reference pressure "Ps" is detected, the ECU 80 drives the selector valve 60 to the ON-position while the pump 40 is driven. That is, the pump 40 is driven in a condition where the selector valve 60 connects the first pump passage 31 and the second pump passage 32. Thereby, the air in the fuel tank 2 is discharged to the atmosphere through the first purge passage 21, the canister 23, the first pump passage 31, the selector valve 60, the second pump passage 32, the pump 40, the first atmospheric passage 51, and the filter 3. Therefore, the interior of the fuel tank 2 is depressurized.

When the pressure in the second pump passage 32 detected by the pressure sensor 71 is not greater than the reference pressure "Ps", the ECU 80 determines that the fuel vapor leak from the fuel tank 2 is in an allowable range. That is, the ECU 80 determines that no fuel vapor leak from the fuel tank 2 occurs. Meanwhile, when the pressure in the second pump passage 32 detected by the pressure sensor 71 is greater than the reference pressure "Ps", the ECU 80 determines that the fuel vapor leak from the fuel tank 2 is out of the allowable range. That is, the ECU 80 determines that a fuel vapor leak from the fuel tank 2 occurs. The ECU 80 functions as a fuel-vapor-leak determining portion. In the present embodiment, when the fuel vapor leak is out of the allowable range, a warning light in a passenger compartment is turned on to notify a driver of the fuel vapor leak.

As above, the ECU 80 can determines whether the fuel vapor leak is in the allowable range based on the reference pressure "Ps" and the pressure detected by the pressure sensor 71 when the selector valve 60 is positioned at the ON-position to connect the first pump passage 31 and the second pump passage 32 while the pump 40 is driven. That is, the ECU 80, the selector valve 60, the pump 40, the orifice 34, and the pressure sensor 71 define a fuel vapor leak detection unit 7.

(Fuel Vapor Treatment)

Figure 5:
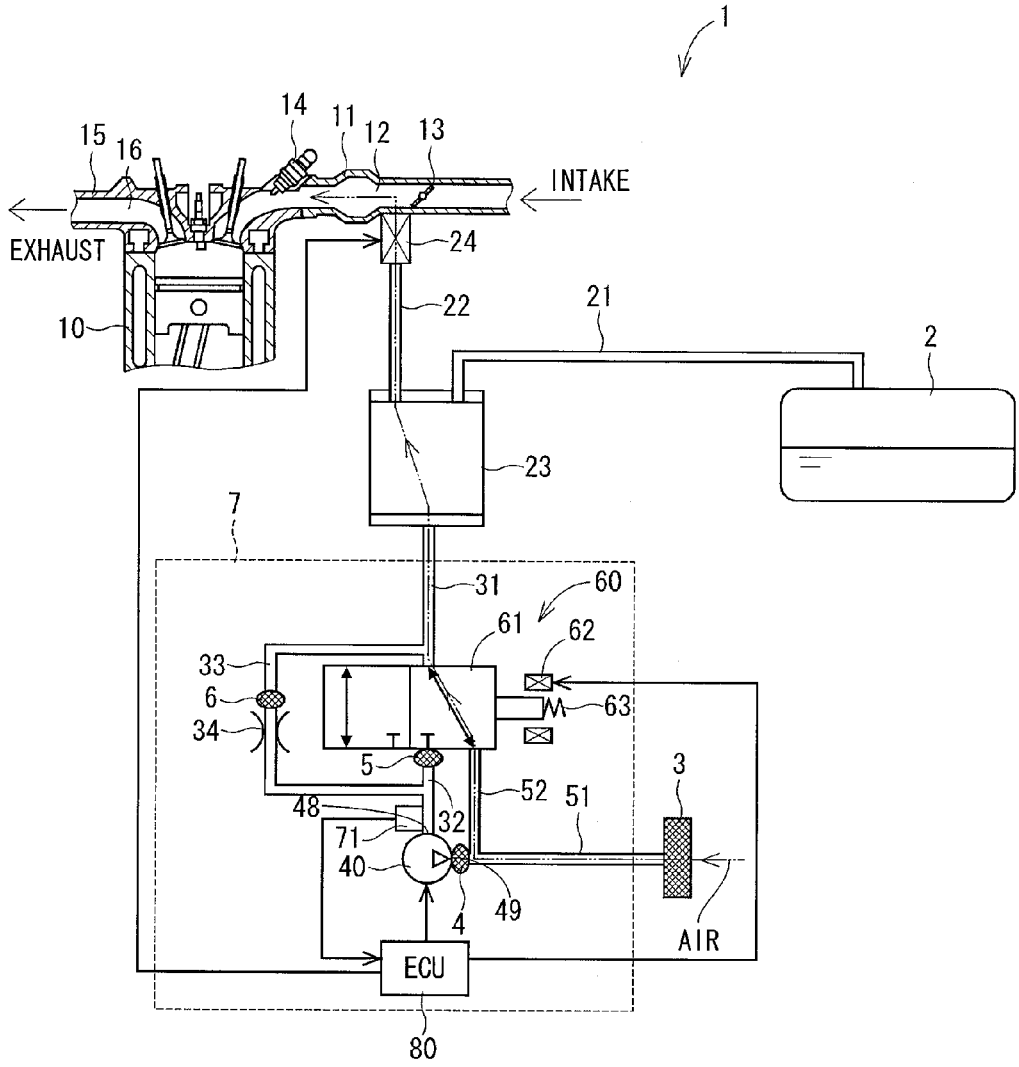
FIG. 5 is a schematic view showing a configuration of a fuel vapor treatment system at a fuel vapor treatment, according to the first embodiment.

When the engine 10 is driven and negative pressure is generated in the intake passage 12, the ECU 80 opens the purge valve 24, as shown in FIG. 5. Thereby, the fuel vapor adsorbed by the canister 23 is purged and introduced into the engine 10 through the intake passage 12. As above, the fuel vapor generated in the fuel tank 2 is combusted in the engine 10. That is, the ECU 80 functions as a fuel purge portion. It should be noted that the ECU 80 computes a target purge amount based on the driving condition of the engine 10, and determines the valve-open time and the valve-open duration of the purge valve 24 based on the target purge amount.

When the purge valve 24 is opened to purge the fuel vapor, the ECU 80 drives the selector valve 60 to the OFF-position so that the first pump passage 31 and the second atmospheric passage 52 are connected to each other. Thereby, the atmospheric air flows into the canister 23 through the first atmospheric passage 51, the second atmospheric passage 52, and the first pump passage 31. As a result, the fuel vapor adsorbed by the canister 23 can be purged smoothly.

As above, the ECU 80 opens the purge valve 24, whereby the fuel vapor adsorbed by the canister 23 can be introduce into the engine 10 through the intake passage 12. Moreover, at this time, the ECU 80 drives the selector valve 60 to the ON-position to connect the first pump passage 31 and the second atmospheric passage 52, whereby the fuel vapor adsorbed by the canister 23 can be purged smoothly.

(Removing Foreign Matters)

Figure 6:
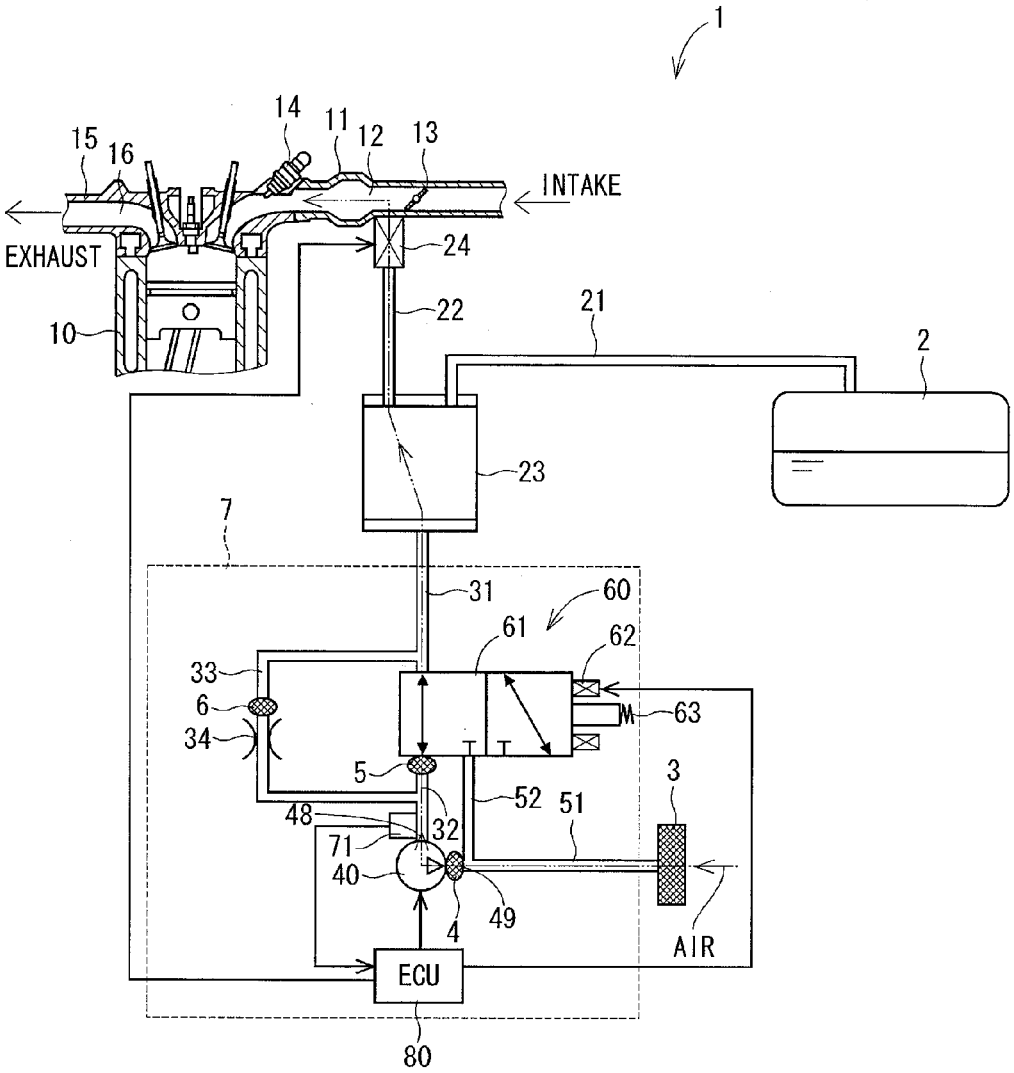
FIG. 6 is a schematic view showing a configuration of a fuel vapor treatment system at a foreign matter removing, according to the first embodiment.

When the purge valve 24 is opened to purge the fuel vapor into the engine 10, the ECU 80 drives the selector valve 60 to the ON-position to connect the first pump passage 31 and the second pump passage 32, as shown in FIG. 6. The atmospheric air flows into the first atmospheric passage 51 through the filter 3. Then, the atmospheric air is introduced into the intake passage 12 through the second fluid port 49, the pump 40 (interior space "S"), the first fluid port 48, the second pump passage 32, the selector valve 60, the first pump passage 31, the canister 23, the second purge passage 22, and the purge valve 24. As above, when the engine 10 is driving, the ECU 80 opens the purge valve 24 and drives the selector valve 60 to the ON-position, whereby the atmospheric air is introduced into the interior of the pump 40 so that the foreign matters in the pump 40 can be removed. The ECU 80 functions as a foreign matter removing portion. The foreign matters include foreign matters which the filters 3, 4 could not capture and the worn powders of the vane 44, the housing 41 and the groove 431.

Figure 7:
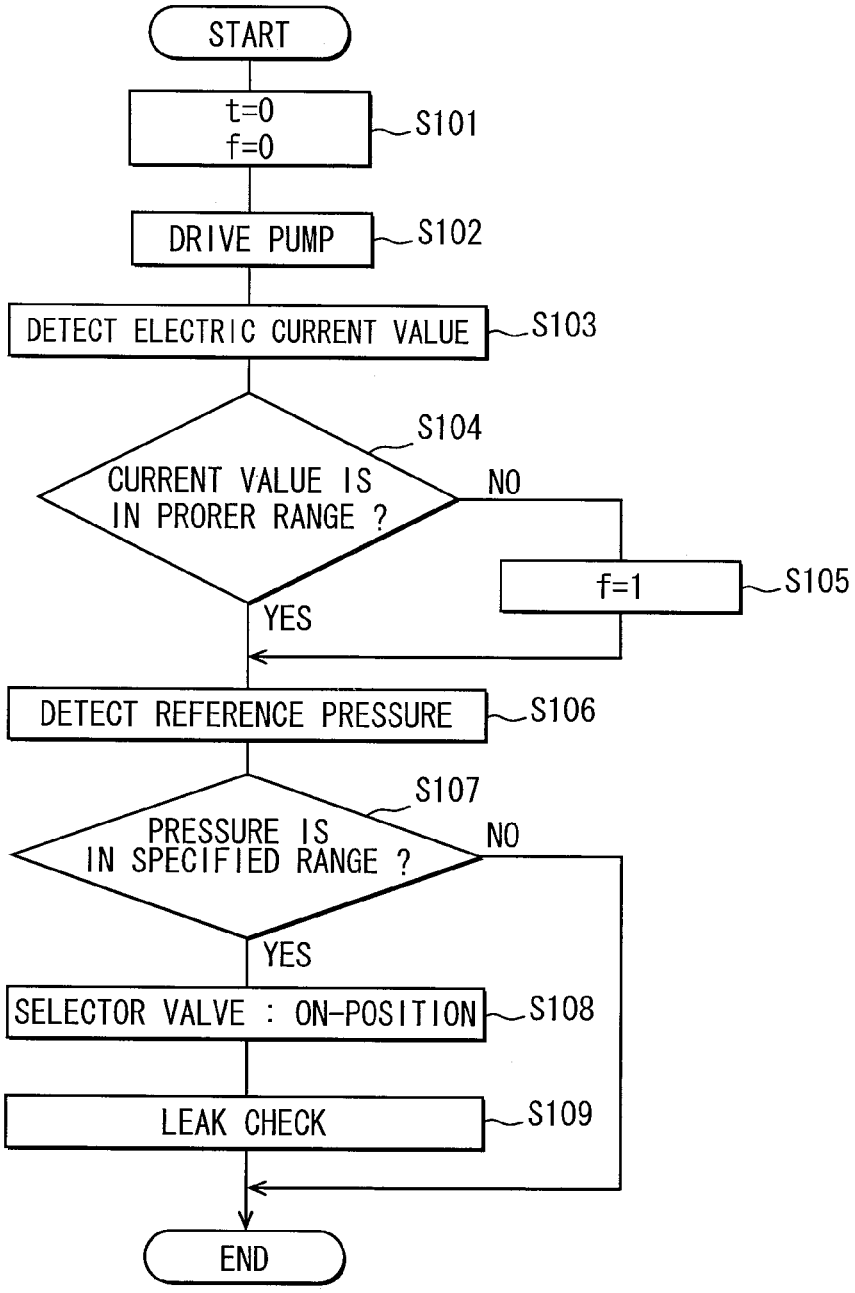
FIG. 7 is a flow chart showing a processing of a reference pressure detection and a fuel vapor leak determination, according to the first embodiment.

Referring to FIG. 7, the processing of the reference pressure detection and the fuel vapor leak determination will be explained.

FIG. 7 is a flow chart showing the processing of the reference pressure detection and the fuel vapor leak determination. When the vehicle is stopped and the engine 10 is shut down, the temperature in the fuel tank 2 and the temperature of the engine 10 are decreased. When these temperatures become stable at a specified value or less, the processing is started.

In S101, the ECU 80 resets a measuring time "t" and a flag "f". That is, it is established as "t"=0 and "f"=0. The ECU 80 counts up "t" at every specified time until the procedure is terminated. Then, the procedure proceeds to S102.

In S102, the ECU 80 drives the pump 40. That is, the motor 45 is energized. Thereby, as shown in FIG. 3, the air flow flowing through the second atmospheric passage 52, the first pump passage 31, the orifice passage 33, the orifice 34, the second pump passage 32, the pump 40, and the first atmospheric passage 51 is formed. The ECU 80 stores the total drive time period of the pump 40 in the RAM. Then, the procedure proceeds to S103.

In S103, the ECU 80 detects the current value of the electric current flowing through the motor 45. The ECU 80 functions as an electric current detector. Then, the procedure proceeds to S104.

In S104, the ECU 80 determines whether the current value detected in S103 is in a proper range. When the answer is YES in S104, the procedure proceeds to S106. When the answer is NO in S104, the procedure proceeds to step S105.

In S105, the ECU 80 sets the flag "f" to "1" (f=1) and stores it in the RAM. After S105, the procedure proceeds to S106.

In S106, the ECU 80 detects the pressure value in the second pump passage 32 by the pressure sensor 71. After S106, the procedure proceeds to S107.

In S107, the ECU 80 determines whether the pressure value detected in S106 is in a specified range. When the answer is YES in S107, the pressure in the second pump passage 32 is defined as the reference pressure "Ps". This reference pressure "Ps" is stored in the RAM. When the answer is NO in S107, the procedure is terminated.

In S108, the ECU 80 drives the selector valve 60 to the ON-position. Thereby, as shown in FIG. 4, the air in the fuel tank 2 is discharged to the atmosphere through the first purge passage 21, the canister 23, the first pump passage 31, the selector valve 60, the second pump passage 32, the pump 40, the first atmospheric passage 51, and the filter 3. Therefore, the interior of the fuel tank 2 is depressurized. After S108, the procedure proceeds to S109.

The ECU 80 functions as a fuel-vapor-leak determination portion. In S109, when the pressure in the second pump passage 32 detected by the pressure sensor 71 is not greater than the reference pressure "Ps", the ECU 80 determines that the fuel vapor leak from the fuel tank 2 is in an allowable range. That is, the ECU 80 determines that no fuel vapor leak from the fuel tank 2 occurs. Meanwhile, when the pressure in the second pump passage 32 detected by the pressure sensor 71 is greater than the reference pressure "Ps", the ECU 80 determines that the fuel vapor leak from the fuel tank 2 is out of the allowable range. That is, the ECU 80 determines that a fuel vapor leak from the fuel tank 2 occurs. After S109, the procedure is terminated.

As described above, the reference pressure detection and the fuel vapor leak determination are conducted.

In the present embodiment, when the total drive time period of the pump 40 exceeds a specified time period, the fuel vapor is purged and the foreign matters are removed form the pump 40, as described above. Thereby, it can be prevented that foreign matters, such as worn powders, accumulate excessively in the pump 40.

Moreover, in the present embodiment, the motor 45 is controlled at a constant speed. When the electric power supplied to the motor 45 is increased and the flag "f" becomes "1" in S105, the ECU 80 estimates that foreign matters accumulate in the pump 40 and the load of the motor 45 is increased.

Then, when the engine 10 is started, the above fuel purge processing and the foreign matter removing processing are compulsorily conducted. Thereby, when the load of the motor 45 is increased due to the accumulation of the foreign matters in the pump 40, the load of the motor 45 can be reduced by removing foreign matters.

In the present embodiment, the ECU 80 conducts the foreign matter removing processing intermittently within a predetermined period, while the purge valve 24 is opened. That is, the ECU 80 drives the selector valve 60 to the ON-position intermittently within a predetermined period, while the purge valve 24 is opened. Thereby, the atmospheric air circulates the interior of the pump 40 intermittently. As a result, the foreign-matter removing efficiency can be enhanced.

Moreover, in present embodiment, when the purge valve 24 is opened and the selector valve 60 is positioned at the ON-position in order to remove the foreign matters, the ECU 80 drives the pump 40. Thereby, the rotor 43 and the vane 44 rotate in the pump 40, and the foreign matters accumulated on the wall of the pump 40 can be removed. As a result, the foreign-matter removing efficiency can be further enhanced.

As explained above, in present embodiment, the ECU 80 controls the system to remove the foreign matters in the pump 40, while the pump performance is not deteriorated.

The pump 40 has a housing 41, a rotor 43 rotatably accommodated in the housing 41, a vane 44 provided to the rotor in such a manner as to radially reciprocate, and a motor 45 driving the rotor 43. The tip end of the vane 44 is slidably in contact with an inner wall surface of the housing 41. The electric motor 45 rotates the rotor 43 and the vane 44. Even if worn powders are generated in the pump 40, it can be restricted that the worn powders accumulate in the pump 40 by conducting the foreign matter removing processing. Furthermore, in present embodiment, the abrasive wear of the parts (the vane 44, the rotor 43, the housing 41) in the pump 40 can be restricted. Therefore, a stable pump performance can be surely maintained for a long time period. As a result, it can be determined whether a fuel vapor leak exists with high accuracy.

Moreover, in present embodiment, the system is provided with the orifice passage 33 which connects the first pump passage 31 and the second pump passage 32, and the orifice 34 provided in the orifice passage 33. The ECU 80 can determines whether the fuel vapor leak from the fuel tank 2 is in the allowable range based on the reference pressure "Ps" and the pressure detected by the pressure sensor 71 when the selector valve 60 is positioned at the ON-position to connect the first pump passage 31 and the second pump passage 32 while the pump 40 is driven. Therefore, a fuel vapor leak determination can be conducted more accurately that a case where the reference pressure is fixed value.

In the present embodiment, the ECU 80 conducts the foreign matter removing processing intermittently within a predetermined period, while the purge valve 24 is opened to introduce the fuel vapor into the engine 10. That is, the ECU 80 drives the selector valve 60 to the ON-position intermittently within a predetermined period, while the purge valve 24 is opened. Thereby, the atmospheric air circulates the interior of the pump 40 intermittently. As a result, the foreign-matter removing efficiency can be enhanced.

Moreover, in present embodiment, when the ECU 80 opens the purge valve 24 and drives the selector valve 60 to the ON-position, the ECU 80 drives the pump 40 (motor 45). Thereby, the rotor 43 and the vane 44 rotate in the pump 40, and the foreign matters accumulated on the wall of the pump 40 can be removed. As a result, the foreign-matter removing efficiency can be further enhanced.

In the present embodiment, when the total drive time period of the pump 40 exceeds a specified time period, the fuel vapor is purged and the foreign matters are removed form the pump 40, as described above. That is, in present embodiment, based on the total drive time period of the pump 40, the ECU 80 determines the time at which the foreign matter removing processing is started. Thereby, it can be prevented that foreign matters, such as worn powders, accumulate excessively in the pump 40.

Moreover, in the present embodiment, the motor 45 is driven at a constant speed. The ECU 80 can detect the current value of the electric current supplied to the motor 45. When the ECU 80 detects that the electric power supplied to the motor 45 is increased, the ECU 80 estimates that foreign matters accumulate in the pump 40 and the load of the motor 45 is increased. Then, when the engine 10 is started, the above fuel purge processing and the foreign matter removing processing are compulsorily conducted. Thereby, when the load of the motor 45 is increased due to the accumulation of the foreign matters in the pump 40, the load of the motor 45 can be reduced by removing foreign matters.

Second Embodiment

Figure 8:
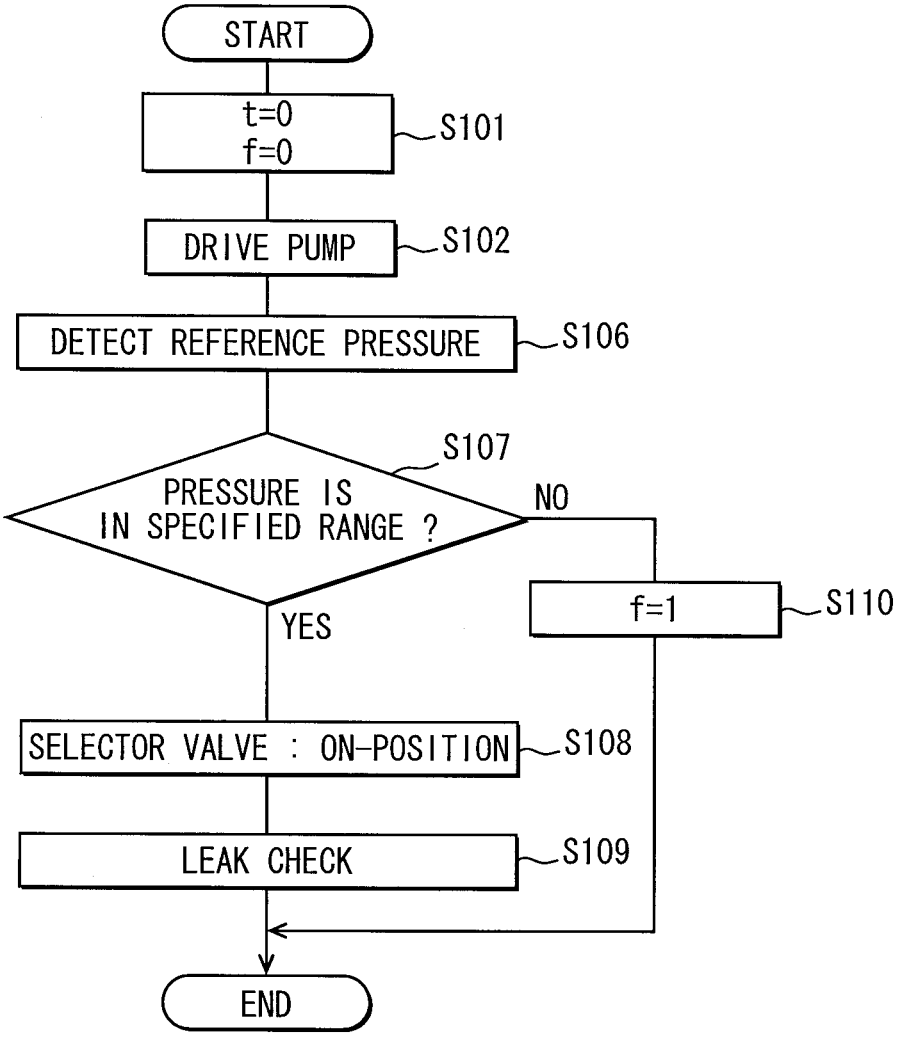
FIG. 8 is a flow chart showing a processing of a reference pressure detection and a fuel vapor leak determination, according to a second embodiment.

Referring to FIG. 8, a second embodiment of the fuel vapor treatment system will be described hereinafter. In the second embodiment, the control method of the motor 45 and the processing of the reference pressure detection and the fuel vapor leak determination are different from those in the first embodiment.

In the second embodiment, the ECU 80 controls the electric power supplied to the motor 45 as a constant electric power. Therefore, if foreign matters accumulate in the pump 40 and the load of the motor 45 is increased, the rotation speed of the motor 45 is decreased. In this case, the pump performance of the pump 40 is deteriorated.

FIG. 8 is a flowchart showing a processing of the reference pressure detection and the fuel vapor leak determination. In this flowchart, the same processings as those in the first embodiment are indicated with the same reference numerals.

When it is determined that the pressure detected in S106 is out of the specified range in S107, the procedure proceeds to S110. In S110, the ECU 80 sets the flag "f" to "1" (f=1) and stores it in the RAM. After S110, the procedure is terminated.

In the present embodiment, as described above, the ECU 80 controls the electric power supplied to the motor 45 so that the supplied electric power is constant. When the pump performance of the pump 40 is deteriorated and the flag "f" becomes "1" in S110, the ECU 80 estimates that foreign matters accumulate in the pump 40 and the load of the motor 45 is increased. Then, when the engine 10 is started, the above fuel purge processing and the foreign matter removing processing are compulsorily conducted. That is, based on a variation of the reference pressure "Ps", the ECU 80 compulsorily conducts the above fuel purge processing and the foreign matter removing processing. Thereby, when the load of the motor 45 is increased due to the accumulation of the foreign matters in the pump 40, the load of the motor 45 can be reduced by removing foreign matters. As the result, the pump performance of the pump 40 can be recovered.

Other Embodiment

In the above embodiments, based on the total drive time period of the pump 40, the ECU 80 determines the time at which the foreign matter removing processing is started. Moreover, in the first embodiment, based on the electric current value supplied to the pump, the purge processing and the foreign matter removing processing are compulsorily conducted. In the second embodiment, based on the variation of the reference pressure, the purge processing and the foreign matter removing processing are compulsorily conducted. Meanwhile, in the other embodiment, when the electric current value supplied to the pump is increased by a specified value more than the previously detected value, the foreign matter removing processing may be started. Moreover, when the reference pressure is decreased by a specified value less than the previous reference pressure, the foreign matter removing processing may be started.

The foreign matter removing processing may be started at an arbitrary time for an arbitrary time period. When the foreign matter removing processing is conducted, the pump may not be driven.

When the purge processing is conducted, the foreign matter removing processing may be continuously conducted in a predetermined period.

In the other embodiment, the orifice passage and the orifice may not be provided. In this case, the reference pressure is a fixed value to perform the fuel vapor leak determination. The pump is not limited to a vane-type pump.

In the above-mentioned embodiments, when the reference pressure detection and the fuel vapor leak determination are conducted, the interior of the fuel tank is depressurized. Meanwhile, in the other embodiment, when the reference pressure detection and the fuel vapor leak determination are conducted, the interior of the fuel tank may be pressurized. Even in this case, the reference pressure can be detected and the fuel vapor leak determination can be conducted.

In the above-mentioned embodiment, when the selector valve is positioned at the OFF-position, the first pump passage and a second atmospheric passage are connected. When the selector valve is positioned at the ON-position, the first pump passage and the second pump passage are connected. Meanwhile, in the other embodiment, when the selector valve is positioned at the OFF-position, the first pump passage and a second pump passage may be connected. When the selector valve is positioned at the ON-position, the first pump passage and the second atmospheric passage may be connected.

The present disclosure is not limited to the embodiments mentioned above, and can be applied to various embodiments.

What is claimed is:

1. A fuel vapor treatment system for introducing a fuel vapor generated in a fuel tank into an internal combustion engine, comprising:

a purge passage connecting the fuel tank and an intake passage through which an intake air is introduced into the internal combustion engine;

a canister provided in the purge passage for adsorbing a part of the fuel vapor flowing through the purge passage;

a purge valve provided in the purge passage between the canister and the intake passage for opening and closing the purge passage;

a first pump passage of which one end is connected to the canister;

a second pump passage of which one end is capable of being connected to another end of the first pump passage;

an electric pump connected to another end of the second pump passage for pressurizing or depressurizing an interior of the fuel tank through the second pump passage, the first pump passage, the canister and the purge passage;

a first atmospheric passage of which one end is connected to the pump and another end is opened to an atmosphere;

a second atmospheric passage of which one end is connected to the first atmospheric passage;

a selector valve provided between another end of the first pump passage, one end of the second pump passage, and another end of the second atmospheric passage, the selector valve switching a passage connection between a first position in which the first pump passage is connected to the second pump passage and a second position in which the first pump passage is connected to the second atmospheric passage;

a pressure detector detecting a pressure in the second pump passage;

a control unit controlling operations of the purge valve, the pump, and the selector valve;

an orifice passage connecting the first pump passage and the second pump passage; and an orifice provided in the orifice passage, wherein:

the control unit includes:

a fuel-vapor-leak determining portion which determines whether a fuel vapor leak from the fuel tank is in an allowable range based on a reference pressure detected by the pressure detector in a condition where the selector valve connects the first pump passage and the second atmospheric passage and the pump is driven in order to pressurize or depressurize the interior of the fuel tank;

a fuel purge portion which introduces the fuel vapor adsorbed by the canister into the internal combustion engine through the intake passage by opening the purge valve; and a foreign matter removing portion which controls the selector valve to connect the first pump passage and the second pump passage so as to circulate an atmospheric air in the pump while the fuel purge portion introduces the fuel vapor into the internal combustion engine, the control unit determines a time point at which the foreign matter removing portion starts its operation based on a variation of the reference pressure, the control unit compulsorily operates the fuel purge portion and the foreign matter removing portion based on a variation of the reference pressure.

2. A fuel vapor treatment system according to claim 1, further comprising:

an electric current detector which detects a current value of an electric current flowing through the pump, wherein the control unit determines a time point at which the foreign matter removing portion starts its operation based on the detected current value of the electric current.

3. A fuel vapor treatment system according to claim 2, wherein:

the control unit compulsorily operates the fuel purge portion and the foreign matter removing portion based on the detected current value.

4. A fuel vapor treatment system for introducing a fuel vapor generated in a fuel tank into an internal combustion engine, comprising:

a purge passage connecting the fuel tank and an intake passage through which an intake air is introduced into the internal combustion engine;

a canister provided in the purge passage for adsorbing a part of the fuel vapor flowing through the purge passage;

a purge valve provided in the purge passage between the canister and the intake passage for opening and closing the purge passage;

a first pump passage of which one end is connected to the canister;

a second pump passage of which one end is capable of being connected to another end of the first pump passage;

an electric pump connected to another end of the second pump passage for pressurizing or depressurizing an interior of the fuel tank through the second pump passage, the first pump passage, the canister and the purge passage;

a first atmospheric passage of which one end is connected to the pump and another end is opened to an atmosphere;

a second atmospheric passage of which one end is connected to the first atmospheric passage;

a selector valve provided between another end of the first pump passage, one end of the second pump passage, and another end of the second atmospheric passage, the selector valve switching a passage connection between a first position in which the first pump passage is connected to the second pump passage and a second position in which the first pump passage is connected to the second atmospheric passage;

a pressure detector detecting a pressure in the second pump passage;

a control unit controlling operations of the purge valve, the pump, and the selector valve; and an electric current detector which detects a current value of an electric current flowing through the pump, wherein the control unit includes:

a fuel-vapor-leak determining portion which determines whether a fuel vapor leak from the fuel tank is in an allowable range based on a reference pressure detected by the pressure detector in a condition where the selector valve connects the first pump passage and the second atmospheric passage and the pump is driven in order to pressurize or depressurize the interior of the fuel tank;

a fuel purge portion which introduces the fuel vapor adsorbed by the canister into the internal combustion engine through the intake passage by opening the purge valve; and a foreign matter removing portion which controls the selector valve to connect the first pump passage and the second pump passage so as to circulate an atmospheric air in the pump while the fuel purge portion introduces the fuel vapor into the internal combustion engine, the control unit determines a time point at which the foreign matter removing portion starts its operation based on the current value detected by the electric current detector, the control unit compulsorily operates the fuel purge portion and the foreign matter removing portion based on the current value detected by the electric current detector.

5. A fuel vapor treatment system according to claim 4, further comprising:

an orifice passage connecting the first pump passage and the second pump passage; and an orifice provided in the orifice passage, wherein the fuel-vapor-leak determining portion determines whether a fuel vapor leak from the fuel tank is in an allowable range based on:

a reference pressure detected by the pressure detector in a condition that the selector valve connects the first pump passage and the second atmospheric passage while the pump is driven; and a pressure detected by the pressure detector in a condition where the selector valve connects the first pump passage and the second pump passage while the pump is driven in order to pressurize or depressurize the interior of the fuel tank.

6. A fuel vapor treatment system according to claim 5, wherein:

the control unit determines a time point at which the foreign matter removing portion starts its operation based on a variation of the reference pressure.

7. A fuel vapor treatment system according to claim 5, wherein:

the control unit compulsorily operates the fuel purge portion and the foreign matter removing portion based on a variation of the reference pressure.

8. A fuel vapor treatment system according to claim 4, wherein:

the pump has a housing, a rotor rotatably accommodated in the housing, a vane provided to the rotor in such a manner as to radially reciprocate, and a motor driving the rotor;

a tip end of the vane is slidably in contact with an inner wall surface of the housing; and the motor rotates the rotor and the vane.

9. A fuel vapor treatment system according to claim 4, wherein:

the control unit determines a time point at which the foreign matter removing portion starts its operation based on a total drive time period of the pump.

10. A fuel vapor treatment system according to claim 4, wherein:

the control unit operates the foreign matter removing portion intermittently in a predetermined period while the fuel purge portion is operated to introduce the fuel vapor into the internal combustion engine.

11. A fuel vapor treatment system according to claim 4, wherein:

the control unit drives the pump while the foreign matter removing portion is operated.

* * * * *